United States Patent [19]

Dunning et al.

[11] 4,087,287

[45] May 2, 1978

[54] METHOD FOR PROVIDING FERRITIC-IRON-BASED ALLOYS

[75] Inventors: John S. Dunning; Mark I. Copeland, both of Corvallis; John S. Howe, Albany, all of Oreg.

[73] Assignee: The United States of America as represented by the Secretary of the Interior, Washington, D.C.

[21] Appl. No.: 788,059

[22] Filed: Apr. 15, 1977

[51] Int. Cl.[2] ..... C21D 6/02

[52] U.S. Cl. ..... 148/3; 148/142

[58] Field of Search ..... 148/142, 2, 31, 3, 12.3

[56] References Cited

U.S. PATENT DOCUMENTS

| | | | |
|---|---|---|---|
| 2,744,821 | 5/1956 | Osman | 148/142 X |
| 2,822,265 | 2/1958 | Eberle et al. | 148/142 X |
| 2,826,496 | 3/1958 | Kegerise | 148/142 X |
| 3,794,532 | 2/1974 | Jones et al. | 148/142 |
| 3,871,928 | 3/1975 | Smith, Jr. et al. | 148/142 |

FOREIGN PATENT DOCUMENTS

| | | | |
|---|---|---|---|
| 1,201,031 | 8/1970 | United Kingdom | 148/142 |

OTHER PUBLICATIONS

Iron and Steel (1970), pp. 1747–1756, article by M. Takeyama et al.

*Primary Examiner*—Edward Stern

*Attorney, Agent, or Firm*—William S. Brown; Donald A. Gardiner

[57] ABSTRACT

A strengthened creep resistant ferritic iron alloy is provided by alloying the iron with two or more alloying metals of the type that form an intermediate Laves phase in the alloy having the composition $Fe_2X$, where X is the alloying metal. One of the alloying metals comprises one to five weight percent of tantalum and/or columbium while the other metal comprises one to eight weight percent of molybdenum and/or tungsten. The total of the Laves phase forming alloying metals is no more than ten weight percent in excess of that necessary to react with interstitial elements that may be added to the alloy.

3 Claims, 7 Drawing Figures

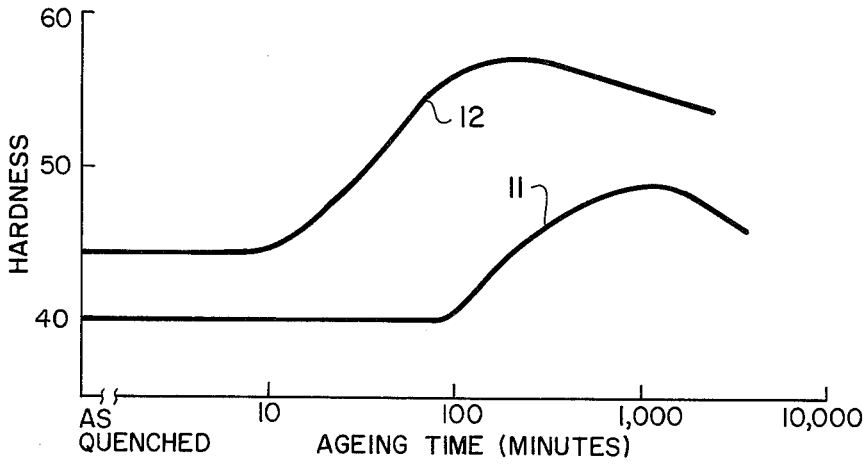
FIG. 1
FIG. 2
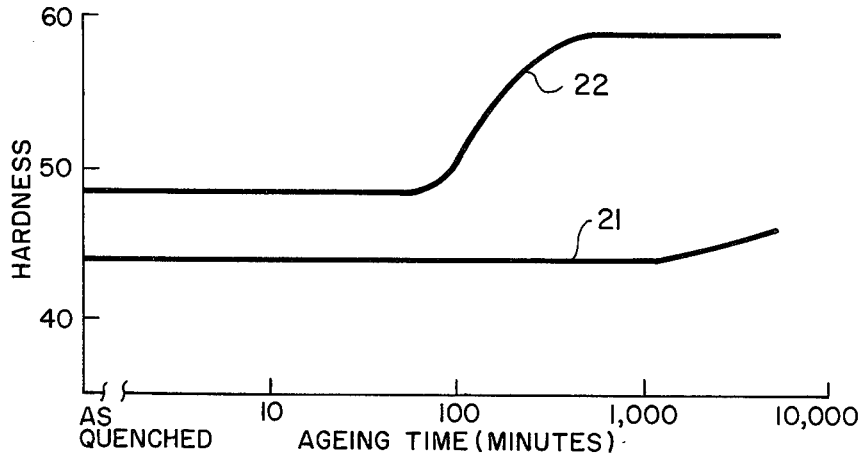
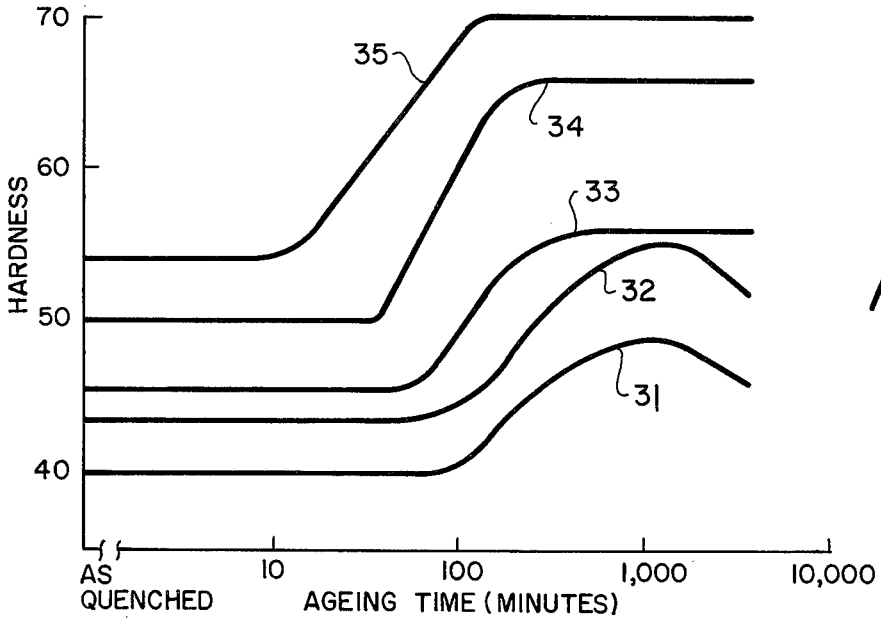
FIG. 3

METHOD FOR PROVIDING FERRITIC-IRON-BASED ALLOYS

FIELD OF THE INVENTION

This invention relates to the metallurgy of ferritic iron-based alloys and, more particularly, to the strengthening of such alloys by a fine dispersion of Laves phases in the iron matrix.

BACKGROUND OF THE INVENTION

A number of commercial alloys derive their high temperature strength from fine dispersions of a second phase material. In creep-resistant ferritic materials, these dispersions are characteristically carbides. In high nickel superalloys, the dispersed phase is often an intermetallic compound such as $Ni_3$ (Al,Ti). The thermal stability of the dispersed phase is an important factor, particularly in determining elevated temperature creep resistance. The term "Laves phase" refers to a hard intermetallic compound that is comparatively stable at high temperature. A dispersion of such a stable intermetallic compound in an iron matrix is thought to be more resistant to coarsening and softening at elevated temperatures than a carbide dispersion.

The concept of using intermetallic compounds such as Laves phases, rather than carbides, for increasing the high temperature strengths of alloys is not new, but optimum high temperature creep strengths have not been realized in oxidation resistant alloys that are fabricable by conventional techniques.

A fine dispersion of intermetallic compounds, such as Laves phases, can be precipitated in the matrix of an iron-based alloy by a suitable heat treatment. The alloy is solution heat-treated at a temperature high enough to achieve solution of second phase precipitates in the iron-rich matrix. The alloy is cooled at a rate which is sufficiently rapid to retain a single-phased metastable structure, and then it is aged at a lower intermediate temperature to precipitate the second phase as a fine dispersoid. This fine dispersoid of second phase hardens and strengthens the matrix. Overageing occurs when precipitation is complete, a maximum hardness is reached, and further elevated temperature exposure results in a coarsening of the second-phase precipitates and decreasing hardness and strength. The heat treatment is known as precipitation hardening, and both the magnitude of hardening achieved and the stability of the hardening response in terms of overageing are reflected in the elevated temperature strength of a precipitation hardened alloy.

Precipitation of Laves phases from supersaturated ferritic iron ($\alpha$-iron) has been the subject of investigation for decades and the hardness variation with time at a given ageing temperature for numerous binary systems has been determined. In a comparatively recent study, Hornobogen, E., "Precipitation from Iron-Base Alloys", G. R. Speich and J. B. Clark, Eds., vol. 23, p. 31, Gorden and Breach Science Publ., N.Y., (1965), the binary systems Fe—Be, Fe—Ti, and Fe—W were studied. In another study of interest, Speich, G.R., Trans. Met. Soc. AIME, vol. 224, p. 850 (1962), Fe—Cb and Fe—Ti systems were considered. It is noted that secondary additions, in particular chromium, have been added to binary systems but the changes in the precipitation hardening characteristics were not usually significant and in some cases overageing and softening were accelerated. Reference is made to Vowles, M.D. J., and West, D. R. F., J.I.S.I., p. 147 (1973) for a discussion of this approach. The most recent literature data on Laves phase strengthening of ferritic iron are reported by the Center for the Design of Alloys, University of California, Berkeley, California. Reference is also made to Zackay, V. F., F. R. Parker, and D. Bhandarker, John Dom Memorial Symposium, AIME, Cleveland, Ohio, (Oct. 1972); Bhat, M.S., M.S. Thesis, Univ. of California, Berkeley, LBL2277, (April 1974); Jones, R. H., V. F. Zackay, and E. R. Parker, Met. Trans., vol. 3, p. 2835, (Nov. 1972); Zackay, V. F., et al., Materials Science and Engineering 16, p. 201, (1974); and Bhandarkar, M.D., et. al., Met. Trans., vol 6A, p. 1281, (June 1975). These studies are representative of the current state of the art and concern the precipitation of Laves phases from super saturated $\alpha$-iron in the binary systems Fe—Be, Fe—Cb, Fe—Ti, Fe—W, Fe—Mo, and Fe—Ta.

The principal disadvantage of the prior art has been that with low alloying additions, stable hardening and strengthening responses have not been achieved. The lack of stability has been reflected in stress-rupture strengths lower than those achieved by some alloys strengthened by carbides, as is demonstrated in the current state of the art studies referred to above. Low alloying additions to achieve hardening and strengthening are desirable to allow for further additions, such as chromium and aluminum, to provide oxidation resistance without substantial reductions in fabricability. In most of the studies referred to, the data are limited to age hardening characteristics and elevated temperature creep data were not studied. As noted, in cases where elevated temperatures were studied, the elevated temperature strengths were low and for example, in one of the studies referred to (see the Bhandarkar et al and Zackay et al references), involving an iron-based alloy strengthened by the Laves phase $Fe_2Ta$, the 1,100° F (593° C) stress rupture strengths were below that of 422 stainless steel, and above this temperature, the strengths declined rapidly below useful values.

SUMMARY OF THE INVENTION

The invention concerns a method of producing iron-base alloy compositions which exhibit Laves phase precipitation hardening and strengthening of exceptional magnitude and stability at elevated temperatures. Generally speaking, the invention involves alloying the iron together with two or more alloying additions which form Laves phases in the alloy, the use of two such additions providing a synergistic effect on strengthening as compared with comparable binary (single addition) systems.

The additions total no more than 10 wt-pct. However, if the alloy contains carbon or other interstitials that combine more preferentially with the alloying additions than the latter does with iron at the Laves phase precipitation temperatures or above, the alloy additions then may exceed the 10 wt-pct limit sufficiently so that enough is present to combine with the interstitial element and still form Laves phase dispersoids. As noted, where, for example, the melted metals contain carbon, the additions can exceed the 10 wt-pct limit by an amount sufficient to provide enough tantalum and/or columbium to still form Laves phase dispersoids after combining with the carbon. In an optimum system, one addition is 1 to 5 wt-pct tantalum and/or columbium and the other addition is 1 to 8 wt-pct molybdenum and/or tungsten. As noted, the combined effect of the additions result in hardening and strengthening, after appropriate precipitation heat treatments, of a magnitude and stability that cannot be realized in Laves phase forming, iron-rich binary alloys with total additions of less than 10 wt-pct. Further, in addition to the up to 10 wt-pct Laves phase forming metals, chromium and/or aluminum may be alloyed with the alloy for corrosion- and oxidation-resistant properties and solid solution strengthening.

The strengthened iron alloys are preferably prepared by melting, casting, possibly plastically deforming, and then precipitation heat treating. Melting of the alloy contents should be conducted in a manner such that the oxidation of the additions is minimized, e.g., by consumable-electrode arc melting or vacuum-induction. The molten metal may be cast into powders or into shapes for use in its cast shape or for further fabrication, such as forging, rolling, or swaging, into the final desired configuration. Cast powder may be compacted, sintered, and plastically worked into final shape. The final configuration is then heat treated to develop the best strength characteristics for the intended application. The alloy is solution heat treated to dissolve any coarse Laves phases in the alloy that may have formed during processing. Afterwards, the alloy is cooled from the solution treatment temperature to or below the ageing temperature at a rate sufficiently rapid to prevent the formation of coarse Laves phase dispersoids. Finally, the alloy may be aged or plastically deformed and aged. The plastic working temperature should be at or below the ageing temperature. Further, the ageing temperature should be one which gives maximum hardening and strengthening at the desired temperature application in a reasonable length of time.

In general, the alloy is heated at a sufficiently high temperature and for a sufficient length of time so as to obtain a solid solution of the alloy additions in the iron matrix. Further, the solution heat-treated alloy is cooled at a sufficiently rapid rate to the ageing temperature, or lower, to obtain a metastable structure containing a minimum content of coarse Laves phase dispersoids. Moreover, the cooled alloy is aged, or plastically worked and aged, at a temperature sufficient to form ultrafine Laves phase precipitates in the iron-rich matrix to sufficiently strengthen the alloy for the intended temperature application.

Further features and advantages of the invention will be set forth in, or apparent from, the detailed description of the invention found hereinbelow.

BRIEF DESCRIPTION OF THE DRAWINGS

FIG. 1 is a graph illustrating the precipitation hardening curve for prior art binary Fe—Cb and Fe—Ta alloys;

FIG. 2 is a graph illustrating the precipitation hardening curve for prior art binary Fe—Mo alloys;

FIGS. 3 and 4 are graphs showing the precipitation hardening curves for Fe-3.5 wt-pct Ta-2 to 10 wt-pct Mo and Fe-2.6 wt-pct Cb-2 to 8 wt-pct Mo alloys, respectively;

BRIEF DESCRIPTION OF THE PREFERRED EMBODIMENTS

Figure 4:
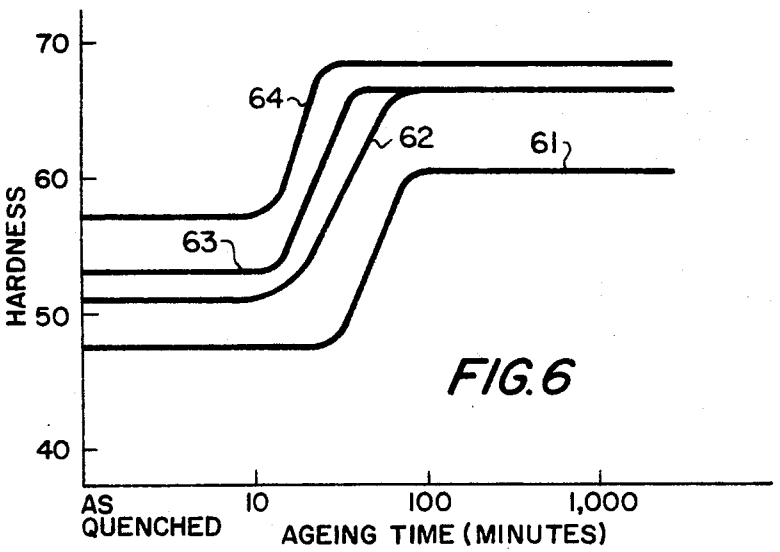

As discussed above, the invention concerns a technique or method for hardening and strengthening iron by precipitation of Laves phase dispersoids during heat treatment of iron-based alloys containing more than one select metal that forms Laves phases therewith, and the alloy so formed. By definition, Laves phases are intermediate phases of the electron compound type, such as the $AB_2$ type compound in binary systems where B is iron and A is the alloying metal, and the atomic diameter of iron to the alloy metal is approximately in the ratio 1.2 to 1. The method of the invention embodies the advantages of both solid solution and dispersion (precipitation) strengthening. By alloying two or more select Laves phase forming metals with iron, casting, and possibly consolidating and plastically working, ultrafine Lanes phase dispersoids can be caused to develop in the iron matrix during subsequent heat treatment. The portion of the alloying elements still soluble in the iron matrix, and not forming Laves phases at the particular ageing temperature during heat treatment or use, serves to solid solution strengthen the iron. As will be shown, hardening and strengthening of exceptional magnitude and stability is achieved at elevated temperatures.

As mentioned hereinbefore, the method of the invention differs from those of the prior art in that stable hardening and stability can be achieved by properly precipitation heat treating iron alloys containing 10 wt-pct or less of Laves phase forming alloying metals. Previous methods were based on the hardening and strengthening characteristics resulting from precipitation of a single phase of the type $Fe_2X$ utilizing a single addition that forms a Laves phase with iron. Below the 10 wt-pct level, the attainment of a maximum hardness or strength and a subsequent overageing (softening) are noted, which indicates a continuous coarsening of the Laves phase during ageing or use of the alloy at elevated temperature. Examples of this condition are illustrated in FIGS. 1 and 2. In accordance with the invention, such overageing is prevented or retarded, depending upon the precipitation or use temperature, by alloying with two or more select Laves phase forming metals.

Referring now to FIGS. 1 and 2, typical prior art hardening responses resulting from singular additions are shown in these figures. The data in these figures were obtained during preliminary studies and the ordinate in each figure is the Rockwell 'A' hardness values taken at room temperature after ageing the alloys, while the abscissa is the logarithmic plot of the ageing time. The alloys used to obtain the data were prepared by arc melting of compacts of sheet chips, granules, or powder of the starting metals and heating and rolling to plate or sheet material. Sections of the material were solution treated at elevated temperature to dissolve in the iron matrix any coarse Laves phases formed during processing, quenched in water, and then aged. It is noted that the other materials presented here were also derived in this manner.

FIG. 1 illustrates the type of precipitation hardening responses observed for iron-rich binary Fe—Cb and Fe—Ta alloys after solution treatment at 1,250° or 1,300° C, quenching, and ageing at 650° C. Curve 11 is that of Fe-3.5Ta, solution treated for 1 hour at 1,250° C, water quenched, and aged at 650° C. Curve 12 is that of Fe-2.6Cb, solution treated for 1 hour at 1,250° C, water quenched and aged at 650° C. The hardness response is the difference in hardness before ageing and the maximum hardness after ageing. A hardening response of good magnitude is obtained, but after relatively short exposures at 650° a maximum hardness is reached and then overageing and softening occurs.

FIG. 2 shows the precipitation hardening response of binary Fe—Mo alloys. Molybdenum additions of 10 wt-pct and more result in a hardening response of good magnitude and stability. Stability is indicated by the flatness of the curve after reaching maximum hardness. It is important to note that, as discussed previously, additions below the 10 wt-pct content result in a slow hardening response of limited magnitude as indicated by the curve for the Fe-7.5 wt-pct Mo alloy.

Turning again to the present invention, iron alloying elements for preventing or retarding overageing and attaining stability after reaching a maximum hardness are two or more selected metals that form Laves phases. These metals are 1 to 5 wt-pct tantalum and/or columbium, i.e., at least one metal selected from the group of tantalum, columbium, and tantalum and columbium in combination with 1 to 8 wt-pct molybdenum and/or tungsten, i.e., at least one metal selected from the group of molybdenum, tungsten, and molybdenum and tungsten. Further, as stated, combinations of these alloying metals up to a limit a 10 wt-pct are used except where the melted metals which contain interstitials which combine more preferentially with the alloying additions than the additions combine with iron, and here the alloy content can exceed the 10 wt-pct limit sufficiently to combine with the interstitials referred to and still form the desired dispersoids.

The method of the invention employs conventional melting, casting, compacting (if used), plastic working, and Laves phase precipitation heat treatment. The melting should be conducted in a manner such that the alloying elements are not oxidized. The molten alloy may be cast into powder, into a shape to be used, or into a shape to be plastically deformed. The cast powder may be consolidated and then plastically worked. Plastic deformation may be conducted by conventional methods, such as forging, rolling, extruding, and the like. As-cast and plastically worked shapes may then be hardened and strengthened by precipitation heat treatments. The full hardness and strength of the as-cast and plastically worked iron-based alloy is developed by subjecting them to heat treatments. The heat treatments comprise conventional solubilizing, cooling, and ageing procedures. The following examples illustrate specific embodiments of the invention.

EXAMPLE 1

In this example, the iron-tantalum-molybdenum system was studied. Molybdenum additions were studied at two tantalum levels, Fe-3.5 wt-pct Ta and Fe-2 wt-pct Ta. Molybdenum additions were studied in terms of fabricability of the resulting alloy and characteristics of the precipitation hardening response. The family of hardening curves for the 3.5 wt-pct Ta is shown in FIG. 3. In FIG. 3, curve 31 represents Fe-3.5Ta, curve 32 represents Fe-3,5 Ta-2Mo, curve 33 represents Fe-3.5 Ta-4Mo, curve 34 represents Fe-3.5Ta-8Mo and curve 35 represents Fe-3.5 Ta-10Mo. Similar data were gathered on the Fe-2 wt-pct Ta system, and a Fe-2 wt-pct Ta-7.5 wt-pct Mo composition exhibited optimum fabricability and hardening response. Ingots approximately 4,000 grams in weight were cast, forged, and rolled to sheet stock. The optimum hardening treatment was a solution heat treatment at 1,140° C, followed by water quenching and ageing at 650° C. Elevated temperature, tensile, and stress rupture data were gathered and are included in Table 1 below and in FIG. 5, respectively. While elevated temperature tensile data were good, the outstanding property is the creep resistance developed by the improved stability of the Laves phase dispersion. Creep data represent a significant improvement over the most recently published data on Laves phase strengthened alloys contained in the references set forth above.

TABLE 1

Elevated temperature tensile data on Fe-2Ta- 7.5Mo Alloy

| Composition | Fe-2Ta-7.5Mo | | |
|---|---|---|---|
| Test Temp. ° C | Ultimate tensile strength (ksi) | Yield strength (ksi) | Elongation (pct) |
| 400 | 92.6 | 52.5 | 10 |
| 650 | 40.6 | 32.7 | 18 |
| | 40.6 | 31.6 | 19 |
| 800 | 20.5 | 20.1 | 19 |

EXAMPLE 2

Figure 5:
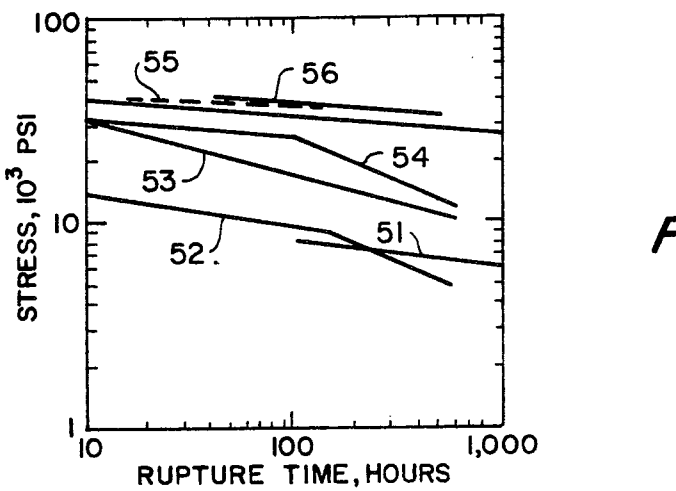
FIG. 5 is a graph showing the time to rupture for commercial alloys and Laves phase strengthened alloys at selected stresses and at a specific temperature (650° C)

In this example, the iron-tantalum-columbium-molybdenum system was studied. Additions in the 1.5 Ta-1.5Cb to 3.5Ta-2.5Cb range were studied with molybdenum additions in the range of 1 to 6 pct. Optimum additions were found to fall within composition ranges of 1 to 5 wt-pct tantalum and columbium and 1 to 8 wt-pct molybdenum for optimum hardening and fabricability. The optimum precipitation hardening treatment together with tensile data for two compositions, Fe—1.5Ta—1.5Nb—4Mo and Fe—2Ta—2Nb—3-Mo—2Cr, are included in Table 2 below and stress rupture data for the latter composition is shown in FIG. 5. Again, stress rupture data were excellent. The Fe—2-Ta—2Nb—3Mo—2Cr alloy contained a 2 wt-pct chromium addition. The chromium plays no significant part in the Laves phase strengthening mechanism, but does add some solid solution strengthening and demonstrates that chromium can be added to the system without degrading the strengthening mechanism. The examples set forth hereinbelow also demonstrate that chromium and aluminum additions do not degrade the strengthening mechanism.

TABLE 2

Elevated temperature tensile data on Fe-1.5Ta-1.5Cb and Fe-2Ta-2Cb-3Mo-2Cr alloy.

| Composition | Fe-1.5Ta-1.5Cb-4Mo | | | Fe-2Ta-2Cb-2Cr-3Mo | | |
|---|---|---|---|---|---|---|
| Test temp. ° C | Ultimate tensile strength (ksi) | Yield strength (ksi) | Elong. (pct) | Ultimate tensile strength (ksi) | Yield strength (ksi) | Elong. (pct) |
| 650 | 45.0 | 38.6 | 7 | 45.3 | 42.5 | 7 |
| | 44.8 | 41.1 | 6 | 47.1 | 44.2 | 5 |
| 800 | 17.1 | 17.0 | 18 | 17.8 | 17.2 | 14 |

EXAMPLE 3

In this example, the iron-columbium-molybdenum system was studied. In this case, hardening characteristics were studied in the composition range referred to above and excellent hardening characteristics were achieved as shown in FIG. 4. In FIG. 4, curve 41 represents Fe—2.6Cb, curve 42 represents Fe—2.6Cb—2Mo, curve 43 represents Fe—2.6Cb—4Mo, curve 44 represents Fe—2.6Cb—6Mo and curve 45 represents Fe—2.6Cb—8Mo. Additions of chromium and aluminum were added and it was shown that chromium and aluminum could be added without degrading the hardening response or fabricability.

Figure 6:
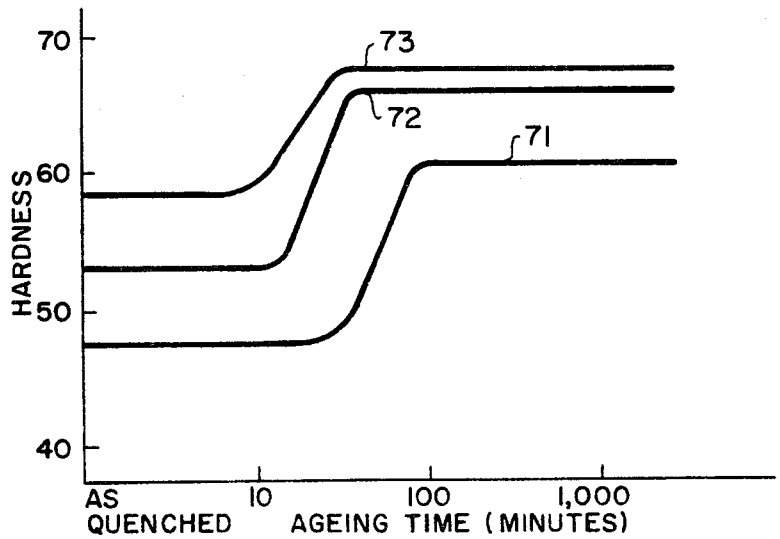
FIG. 6 is a graph showing the precipitation hardening curves for Fe-2.5 wt-pct Cb-2 and 4 wt-pct Mo alloys and the same alloys containing 7 wt-pct chromium.

FIG. 6 shows the effect of a 7 wt-pct chromium addition on the hardening characteristics of two Fe—Cb—Mo alloys. In FIG. 6, curve 61 represents Fe—2.5-Cb—4Mo, curve 62 represents FE—2.5Cb—2Mo, curve 62 represents Fe—7Cr—2.5Cb—4Mo and curve 64 represents Fe—7Cr—2.5Cb—2Mo. The chromium addition adds an overall solid solution hardening effect moving both curves upward on the ordinate of the hardening curve. Both the magnitude and stability of the hardening response are unaffected, however.

Figure 7:
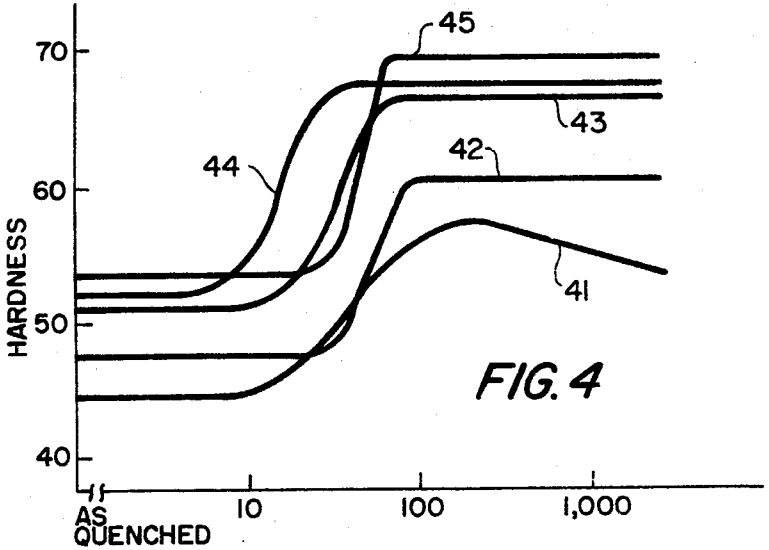
FIG. 7 is a graph showing the precipitation hardening curves for Fe-2.5 wt-pct Cb-2 wt-pct Mo alloys and the same alloy containing 7 wt-pct chromium or 7 wt-pct chromium plus 5 wt-pct aluminum.

FIG. 7 shows the effect of a combined aluminum and chromium addition. In FIG. 7, curve 71 represents FE—2.5Cb—2Mo, curve 72 represents Fe—7Cr—2.5-Cb—2Mo and curve 73 represents Fe—5Al—7Cr—2.5-Cb—2Mo. Aluminum does change the profile of the hardening curve, but the stability of the hardening response remains unaffected. Thus, oxidation resistant, fabricable alloys should be possible with excellent elevated temperature properties.

Although the invention has been described relative to examplary embodiments thereof, it will be understood that other variations and modifications can be effected in these embodiments without departing from the scope and spirit of the invention.

We claim:

1. A method of producing strengthened creep resistant ferritic iron alloys, said method comprising:

(a) forming a molten metal alloy by melting iron together with at least first and second alloying metals of the type that form Laves phases, said first alloying metal comprising one to five weight percent of at least one metal selected from the group consisting of tantalum, columbium, and a mixture of tantalum and columbium, and said second alloying metal comprising one to eight weight percent of at least one metal selected group the group consisting of molybdenum, tungsten, and a mixture of molybdenum and tungsten, the total of said Laves phase- forming alloying metals being no more than ten weight percent in excess of that necessary to react with interstitial elements that may be added to the alloy, and wherein at least a metal selected from the group consisting of aluminum, chromium or a mixture thereof is added to said alloy to provide oxidation resistance, (b) shaping said molten metal alloy by casting;

(c) solution heat treating the alloy to precipitate Laves phases therein;

(d) quenching said alloy to a temperature at or below that suitable for aging; and (e) aging said alloy at a temperature sufficient to produce fine dispersions of Laves phases in the iron matrix of said alloy.

2. A method as claimed in claim 1 wherein aluminum is added to said alloy to provide oxidation resistance.

3. A method as claimed in claim 1 wherein chromium is added to said alloy to provide oxidation resistance.

* * * * *